US006926316B2

(12) United States Patent
Patire et al.

(10) Patent No.: US 6,926,316 B2
(45) Date of Patent: Aug. 9, 2005

(54) PORTABLE SECURITY LOCKS

(76) Inventors: Thomas J. Patire, 281 Rte. 46 West, Elmwood Park, NJ (US) 07407; Emil Mueller, 14818 Fripps Island Ct., Naples, FL (US) 34119

( * ) Notice: Subject to any disclaimer, the term of this patent is extended or adjusted under 35 U.S.C. 154(b) by 55 days.

(21) Appl. No.: 10/649,820

(22) Filed: Aug. 28, 2003

(65) Prior Publication Data

US 2005/0046201 A1 Mar. 3, 2005

(51) Int. Cl.[7] ..... E05C 19/18
(52) U.S. Cl. ..... 292/290; 292/292; 292/295
(58) Field of Search ..... 292/288, 289, 292/290, 291, 292, 293, 294, 296

(56) References Cited

U.S. PATENT DOCUMENTS

| | | | | |
|---|---|---|---|---|
| 359,815 | A | 3/1887 | Sargent | |
| 710,118 | A * | 9/1902 | prud'homme | 292/294 |
| 1,065,396 | A | 6/1913 | Rose | |
| 1,290,560 | A | 1/1919 | Howard | |
| 1,590,133 | A | 6/1926 | Tennyson | |
| 1,782,289 | A | 11/1930 | Cox | |
| 1,947,773 | A | 2/1934 | Haviland | |
| 1,971,440 | A | 8/1934 | Aubertin | |
| 2,461,398 | A * | 2/1949 | Sands | 292/297 |
| 2,588,077 | A | 3/1952 | Beadle | |
| 2,673,112 | A | 3/1954 | Andrews | |
| 2,786,705 | A * | 3/1957 | Stalmer | 292/297 |
| 2,903,286 | A | 9/1959 | Richard et al. | |
| 3,411,817 | A * | 11/1968 | Carver | 292/298 |
| 3,563,593 | A | 2/1971 | Leier | |
| 3,589,761 | A | 6/1971 | Lambert | |
| 3,961,816 | A | 6/1976 | Mueller | |
| 3,997,206 | A | 12/1976 | Hagopian | |
| 4,043,578 | A * | 8/1977 | Downs | 292/290 |
| 4,169,619 | A | 10/1979 | McCracken | |
| 4,290,635 | A | 9/1981 | McKenzie | |
| 4,330,146 | A | 5/1982 | Sessions, Jr. | |
| 4,341,042 | A | 7/1982 | Schulz | |
| 4,382,621 | A * | 5/1983 | Lum | 292/210 |
| 4,387,919 | A | 6/1983 | Quaintance et al. | |
| 4,399,672 | A | 8/1983 | Moorhouse | |
| 4,653,786 | A | 3/1987 | Bopst, III | |
| 4,763,938 | A | 8/1988 | Schlanger | |
| 4,770,451 | A | 9/1988 | Souza | |
| 4,878,701 | A | 11/1989 | Rondel et al. | |
| 5,035,128 | A | 7/1991 | Ridgway | |

(Continued)

*Primary Examiner*—Gary Estremsky
(74) *Attorney, Agent, or Firm*—Millen, White, Zelano & Branigan, P.C.

(57) ABSTRACT

A portable security lock for use with a hinged door includes a base plate that hooks into a keeper opening in a strike plate and a latch plate that is pivoted on the base plate and carries a locking foot which bears against the door when the door is closed. A sliding deadbolt is provided to lock the latch plate to the base plate after the locking foot is pivoted to engage the door. The sliding deadbolt is mounted on the latching plate and has a detent that projects through an opening in the base plate to keep the latching plate from rotating out of engagement with the base plate to thereby keep the latching plate locked to the base plate with the locking foot held against the door.

11 Claims, 4 Drawing Sheets

U.S. PATENT DOCUMENTS

| | | | |
|---|---|---|---|
| 5,154,459 | A | 10/1992 | Cochran |
| 5,193,867 | A | 3/1993 | Husted |
| 5,280,977 | A | 1/1994 | Piva |
| 5,297,829 | A | 3/1994 | Richardson |
| 5,547,236 | A | 8/1996 | Gregory |
| 5,664,814 | A | 9/1997 | Lin |
| 5,704,665 | A | 1/1998 | Budolfson |
| D396,627 | S | 8/1998 | Blad |
| 5,819,561 | A | 10/1998 | Blehi, III |
| 5,836,626 | A | 11/1998 | Coy |
| 6,409,236 | B1 | 6/2002 | Steele |
| 6,416,089 | B1 | 7/2002 | Williams, Jr. |

* cited by examiner

PORTABLE SECURITY LOCKS

FIELD OF THE INVENTION

The present invention is directed to portable security locks. More particularly, the present invention is directed to portable security locks which lock hinged doors closed by engaging with keepers opening through striker plates, the locks having locking elements that engage the doors to retain the doors closed.

BACKGROUND OF THE INVENTION

Many different types of portable door locks have been provided in the past that are designed to be inserted between the edge of a door and a door jamb. These locks are held in engagement with a striker plate on the door jamb and have a component for engaging a face of the door to prevent swinging of the door. Such portable locks usually have a relatively complicated, expensive construction and are difficult to both apply and release. Moreover, these locks tend to have separate pieces which must be interfitted or assembled at the time of application to a door. With locks that have multiple parts there is always the possibility of a part being lost or misplaced while the lock is being stored or carried on one's person.

There is need for a portable security lock of the aforementioned type which can be quickly applied in an emergency situation after one or two practice sessions. Since such a lock may be carried in either a pocket or pocketbook, it would preferably be compact and have minimal parts.

SUMMARY OF THE INVENTION

In view of the aforementioned considerations, the present invention is directed to a portable security lock which is coupled to a keeper opening in a strike plate on a door jamb. The lock has a locking element which engages a door to hold the door closed. The portable security lock according to the invention comprises a base plate having first and second ends with a hook portion disposed at the first end, which hook portion is adapted to enter the keeper opening and engage with a vertical edge of the keeper. The base plate has a length sufficient to protrude a selected distance beyond the door jamb and closed door when the hook portion is engaged with the edge of the keeper opening. A pivot is disposed at the second end of the base plate, and a latching plate is pivoted by a first end thereof on the pivot to rotate toward and away from the door when the portable security lock is mounted on the door jamb. A locking foot is disposed at a second end of the latch plate. Upon the latch plate being pivoted toward the door, the locking foot is adapted to engage the door. A slide mounted on the latching plate has a detent thereon for sliding into engagement with a keeper on the base plate to lock the latching plate to the base plate and thereby hold the locking foot on the latching plate in locking engagement with the door.

In a further aspect of the invention, the pivot extends vertically when the lock is installed in the keeper of a door frame and the slider is mounted on the latching plate for movement toward the locking foot to engage the detent with the keeper on the base plate.

In still a further aspect of the invention, the latching plate has first and second surfaces with the first surface facing the base plate when the latching plate is pivoted over the base plate. The latching plate has an aperature therethrough with the slider mounted on the second surface of the latching plate the detent projecting through the aperature to engage the keeper on the base plate.

In still a further aspect of the portable security lock, the keeper on the base plate is an opening through the base plate, which opening receives the detent and allows a lip on the detent to engage the second surface of the base plate.

In an additional aspect of the invention, the slider has a tab projecting outwardly therefrom in the same direction as the locking foot.

In still and additional aspect of the invention, the foot has a planar surface thereon for facing the door, the planar surface being covered by a resilient pad which abuts the door when the door is shut.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
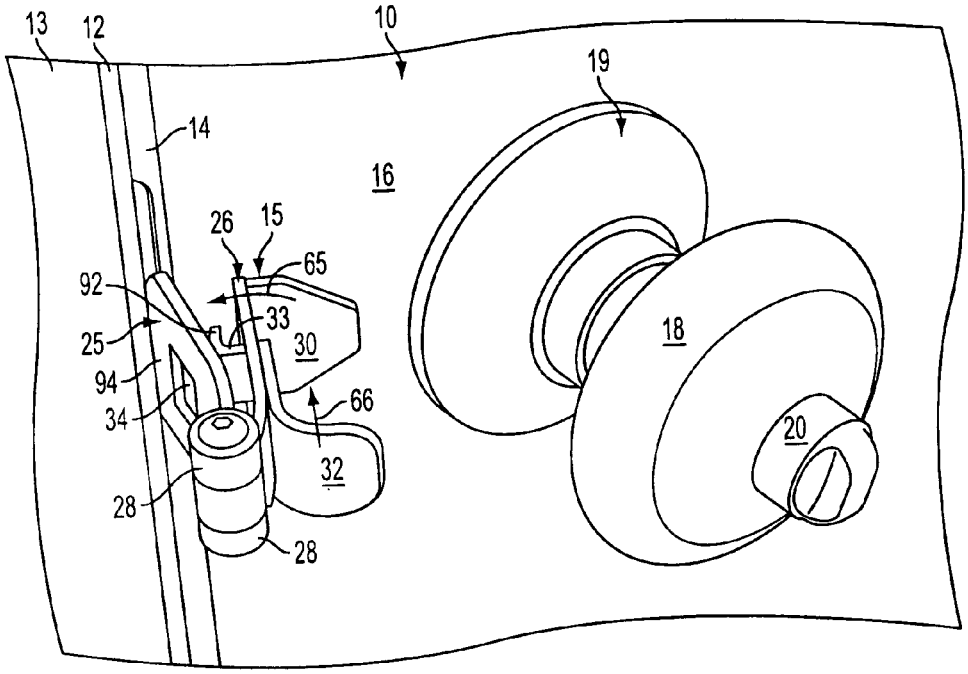
FIG. 1 is a perspective view showing the portable security lock of the present invention locking a door.

Referring now to FIG. 1, a door 10 is locked to a door jamb 12 in a wall 13, which is separated from the door by a gap 14, by utilizing a portable security lock 15, configured in accordance with the principles of the present invention. The door 10 has an interior surface 16 which typically faces into a room. The door 10 is opened by rotating a knob 18 of a lock set 19, which includes a button 20 for locking the door 10 from the inside. The portable security lock 15 includes a base plate 25, which is retained in the gap 14 between the door 10 and the door jamb 12, and a latching plate 26 which is pivoted on the base plate by a hinge 28. The latching plate 26 includes a locking foot 30 which engages the interior surface 16 of the door 10 to hold the door 10 closed with respect to the door jamb 12. A finger tab 32 for a dead bolt 33 is mounted on the latching plate 26. When pushed, the finger tab 32 locks the latching plate 26 to the base plate 25 with the dead bolt 33 by engaging the base plate through opening 34.

Figure 2:
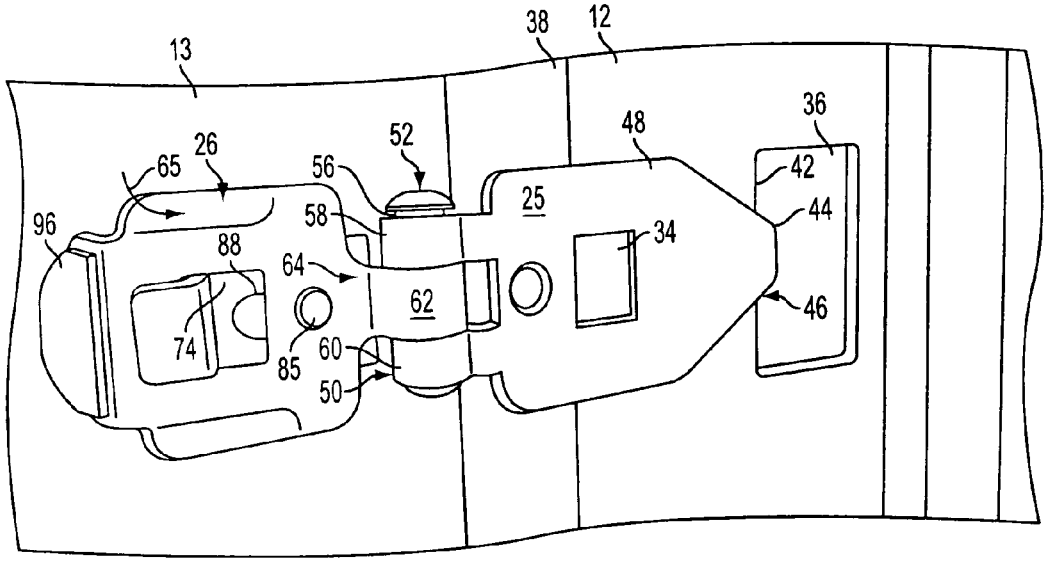
FIG. 2 is a perspective view of the portable security lock of the present invention placed in a keeper opening through a strike plate prior to closing and locking the door as illustrated in FIG. 1.

Referring now to FIG. 2, the door jamb 12 has a keeper opening 36 through a strike plate 38, which keeper opening is engaged by the bolt (not shown) of the lock set 19 (FIG. 1) to cam the bolt back before the bolt is spring projected into the keeper opening 36. The keeper opening 36 has a vertical edge 42 that is engaged by a hook portion 44 on a first end 46 of the base plate 25. The base plate 25 has a web portion 48 having a length sufficient to protrude a selected distance beyond the door jamb 12 and wall 13 into the room closed by the door 16.

At a second end 50 of the base plate 25 a hinge 52 is provided on which the latching plate 26 is pivoted by a pintle 56 retained in hinge lugs 58 and 60 of the hinge. The latch plate 26 has a bearing 62 at the end of a projecting tongue 64 through which the pintle 56 is received.

Figure 3:
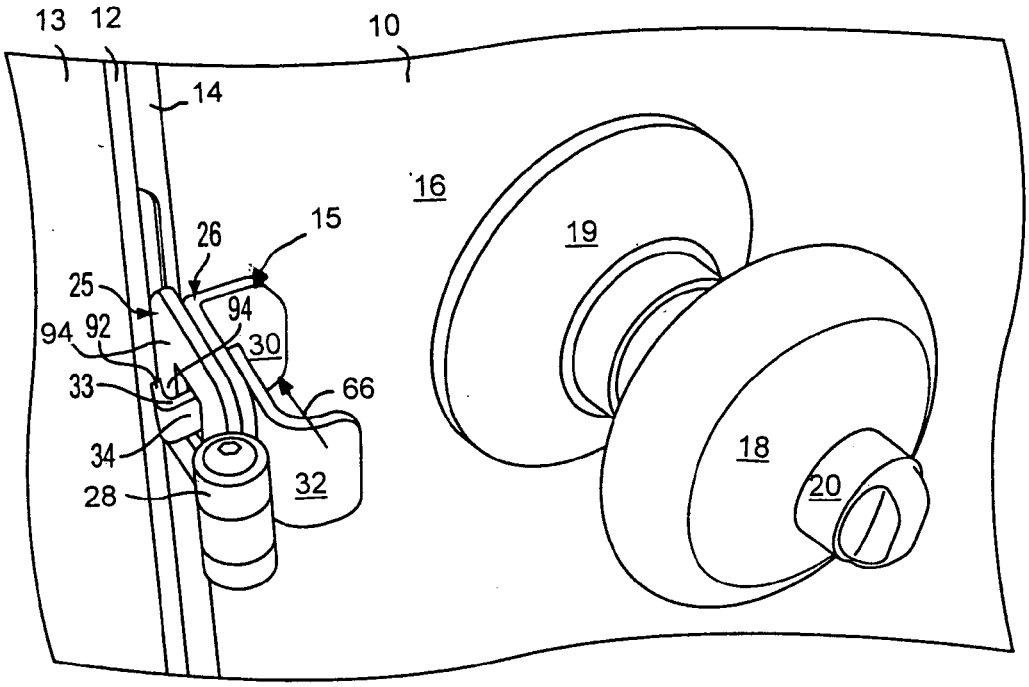
FIG. 3 is a perspective view showing the door locked by the portable security lock.
Figure 4:
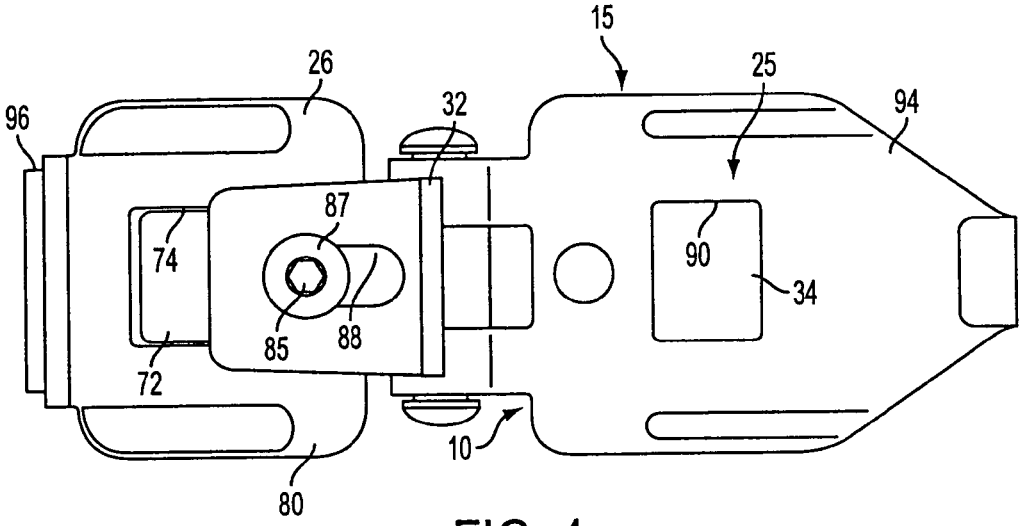
FIG. 4 is a front planar view of a portable security lock of FIGS. 1 and 2.
Figure 5:
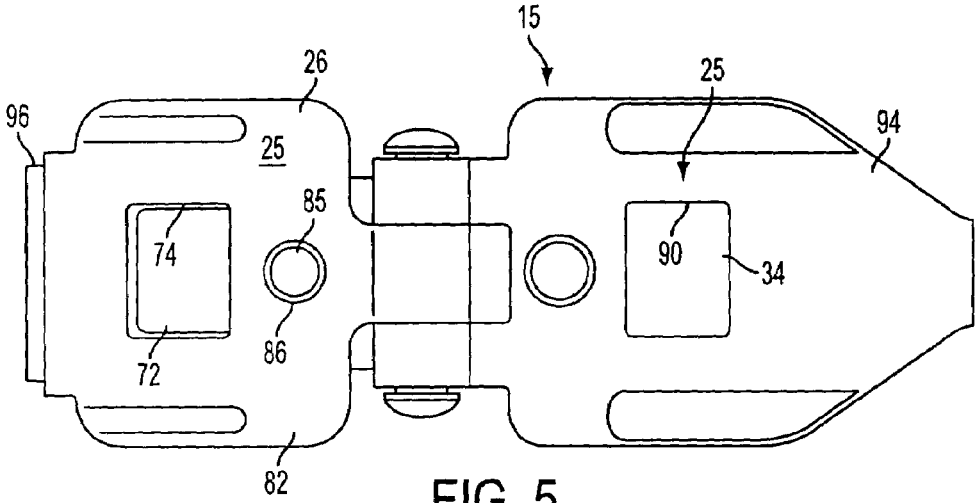
FIG. 5 is a rear planar view of the portable security lock of FIGS. 1–3.

Referring now to FIGS. 1–3, after the door 10 is closed, the latching plate 26 is pivoted in the direction of arrow 65 (FIG. 1) from the FIG. 2 position to the FIG. 1 position. Thereafter, the dead bolt 33 is slid through the opening 34 in the base plate 25 by pushing the finger tab 32 toward the locking foot in the direction of arrow 66. As is seen in FIG. 3, the latching plate 26 can not be rotated away from the base plate 25 because it is retained against the base plate by the dead bolt 33.

When it is desired to release the portable security lock 15, the finger tab 32 is pulled back in a direction away from the locking foot 30 so that deadbolt 33 clears the base plate 25. This releases the latching plate 26 from the base plate 25 and allows the latching plate 26 to pivot from the FIG. 3 position to the FIG. 2 to allow the door 10 to rotate away from the door jamb 12 when a person pushes the door from the outside or pulls on the knob 18 of the lockset 19.

FIGS. 4–8 show the portable security lock 15 separate from the door 10 and door jamb 12. The dead bolt 33 includes a detent 72 that projects through an opening 74 through the latching plate 25. The detent 72 is unitary with a slide plate 76 which also has the finger tab 32 unitary therewith. The slider plate 76 is mounted on a first side 80 of the latching plate 25 with the detent 72 projecting through the opening 74 which extends from a first side 80 to a second side 82 of the latching plate 26. A mounting stud 85 is fixed in a hole 86 through the latching plate 26 and has a head 87 having a diameter larger than a slot 88 through a slider plate 76. The slot 74, which is rectangular, and the stud 85 restrain the slider plate 76 to linear movement.

Figure 7:
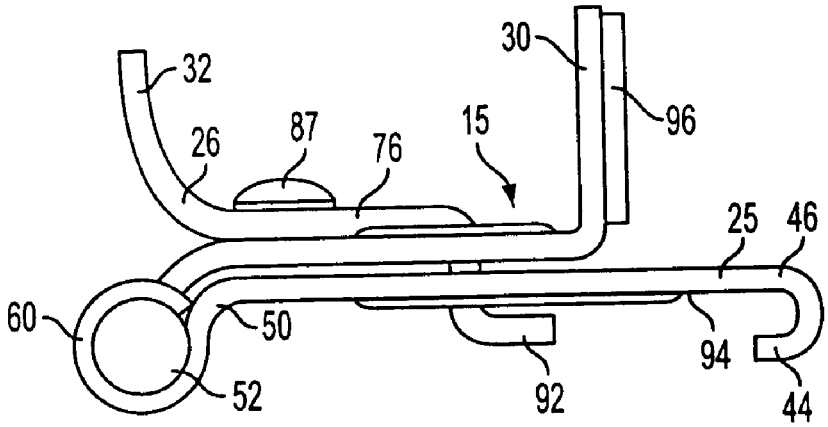
FIG. 7 is a side view showing the security lock of FIGS. 1–5 folded for storage or carrying purposes.
Figure 8:
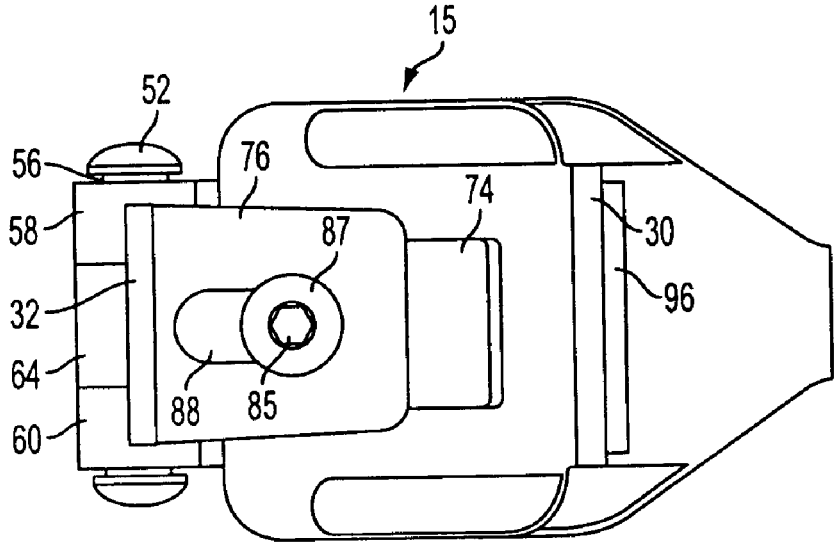
FIG. 8 is a front view of the security lock of FIGS. 1–6 shown folded.

The detent 72 of the dead bolt 33 passes through the opening 34 in the base plate 25 and has a lip 92 which slides behind a first side 94 of the base plate 25 holding the portable security lock 15 folded, as is shown in FIGS. 7 and 8, and the door 10 locked, as shown in FIG. 3. In a preferred embodiment, the locking foot 30 has a plastic or fabric pad 96 thereon which is resilient and is disposed between the inside surface 16 of the door and the locking foot.

Figure 6:
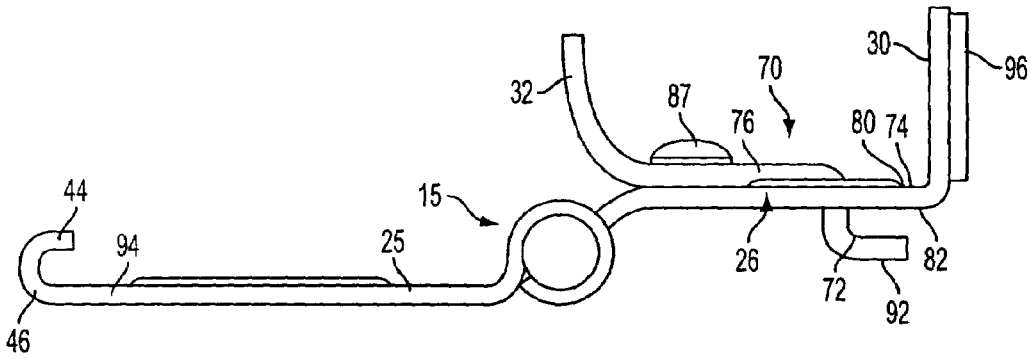
FIG. 6 is a side view of the portable security lock of FIGS. 1–4.

As is seen in FIGS. 6 and 7, the portable security lock 15 is foldable into a very small unit that is less than about 10 cm long and about 6 cm wide with a thickness of about 5 cm. Consequently, the portable security lock 15 can be carried in a pocket, pocketbook or briefcase. Thus, the portable security lock 15 may be carried and used in a building in an emergency situation where a person is threatened with assault, or in other dangerous situations, allowing the person to lock themselves in a room or closet and call 911 on a cell phone. In many situations, the fit is tight enough that the door frame must be broken before access to the room closed by the door 10 is gained. Accordingly, a very simple, extremely effective portable locking device 15 is provided by the aforedescribed structure.

From the foregoing description, one skilled in the art can easily ascertain the essential characteristics of this invention, and without departing form the spirit and scope thereof, can make various changes and modifications of the invention to adapt it to various usages and conditions.

We claim:

1. A portable security lock for a hinged door, the door being latched to a door jamb by a bolt which projects into a keeper opening through a strike plate on the door jamb, the keeper having a vertical edge adjacent to the opening which vertical edge faces away from the opening direction of the door, the portable security lock comprising:

a base plate having a first end and a second end, a hook portion disposed at the first end of the base plate and adapted to enter the keeper opening through the strike plate and engage with the vertical edge;

a web portion of the base plate having a length sufficient to protrude a selected distance beyond the door jamb and a closed door when the hook is engaged with the edge of the keeper;

a pivot disposed at the second end of the base plate;

a latching plate pivoted at a first end thereof on the pivot to rotate toward and away from the door when the portable security lock is mounted on the door jamb to allow the door to clear the portable security lock when the door is being closed;

a locking foot at a second end of the latching plate, the locking foot adapted to engage the door when the door is closed upon the latching plate being pivoted toward the door;

a slider linearly slidably mounted on the latching plate, the slider having a detent thereon for sliding into engagement with a locking surface of the base plate to lock the latching plate to the base plate and hold the locking foot on the latching plate in locking engagement with the door.

2. The portable security lock of claim 1 wherein the pivot extends vertically when the lock is installed in the keeper opening in the striker plate and wherein the slider is mounted to move toward the foot to engage the detent with the surface on the base plate.

3. The portable security lock of claim 2 wherein the latching plate has first and second surfaces with the first surface facing the base plate when the latching plate is pivoted over the base plate and wherein the latching plate has an aperture therethrough, the slider being mounted on the second surface with the detent on the slider projecting through the aperture to engage the locking surface on the base plate.

4. The portable security lock of claim 3 wherein the base plate has an opening therethrough that receives the detent therethrough and allows a lip on the detent to engage the locking surface of the base plate.

5. The portable security lock of claim 4 wherein the pivot is a hinge having bearing portions which project away from the second surface of the base plate and which receive a pintle that secures the latching plate thereon at a position displaced from the door when the latching plate is pivoted away from the door.

6. The portable security lock of claim 5 wherein the latching plate has a bearing receiving pintle displaced away from the first side of the latching plate so that the latching plate rests against the base plate when pivoted thereover.

7. The portable security lock of claim 6 wherein the slider has a tab projecting therefrom in the same direction as the locking foot.

8. The portable security lock of claim 7 wherein the locking foot has a planar surface thereon for facing the door, the planar surface being covered by a resilient pad which abuts the door when the locking foot bares thereagainst.

9. The portable security lock of claim 1 wherein the locking foot has a planar surface thereon for facing the door, the planar surface being covered by a resilient pad which abuts the door when the locking foot bares thereagainst.

10. The portable security lock of claim 1 wherein the latching plate has first and second surfaces with the first surface facing the base plate when the latching plate is pivoted over the base plate and wherein the latching plate has an aperture therethrough, the slider being mounted on the second surface and the detent on the slider projecting through the aperture to engage the locking surface on the base plate.

11. The portable security lock of claim 1 wherein the pivot is a hinge having bearing portions which project away from the second surface of the base plate and which receive a pintle that secures the latching plate thereon at a position displaced from the door when the latching plate is pivoted away form the door.

* * * * *

UNITED STATES PATENT AND TRADEMARK OFFICE

CERTIFICATE OF CORRECTION

PATENT NO. : 6,926,316 B2
APPLICATION NO. : 10/649820
DATED : August 9, 2005
INVENTOR(S) : Thomas J. Patire et al.

It is certified that error appears in the above-identified patent and that said Letters Patent is hereby corrected as shown below:

Column 6, line 8, reads “away form the” should read -- away from the --

Signed and Sealed this

Twenty-ninth Day of August, 2006

JON W. DUDAS
*Director of the United States Patent and Trademark Office*